US005722841A

United States Patent [19]

Wright

[11] Patent Number: 5,722,841

[45] Date of Patent: Mar. 3, 1998

[54] GROUND MEMBER AND CONDUCTOR MODULE CONTAINING SAME

[75] Inventor: John O. Wright, York, Pa.

[73] Assignee: Osram Sylvania Inc., Danvers, Mass.

[21] Appl. No.: 730,953

[22] Filed: Oct. 16, 1996

[51] Int. Cl.[6] ..... H01R 4/66

[52] U.S. Cl. ..... 439/98; 174/78; 174/88 C

[58] Field of Search ..... 439/98, 99, 96, 439/581, 578; 174/78, 84 R, 88 C, 91–93

[56] References Cited

U.S. PATENT DOCUMENTS 2,536,003 12/1950 Dupre ..... 174/88 C 3,897,127 7/1975 Haitmanek ..... 174/78

4,565,417 1/1986 Dussel et al. ..... 439/98

5,028,742 7/1991 Redman ..... 439/98

*Primary Examiner*—Gary F. Paumen

*Attorney, Agent, or Firm*—William H. McNeill

[57] ABSTRACT

A ground member, and method of forming same, is provided wherein a ground strap is electrically attached to the shield layer of a coaxial cable. To this end, a conductive ground strap is sandwiched between a sleeve and the shield layer. The sleeve may be in the form of a conductive sleeve which is crimped to the coaxial cable. A connector module containing such a ground member is also provided.

11 Claims, 2 Drawing Sheets

GROUND MEMBER AND CONDUCTOR MODULE CONTAINING SAME

TECHNICAL FIELD

The present invention relates to a ground member, and to a connector module which includes such a ground member. The ground member of the present invention is particularly useful in attaching a flexible ground strap to a length of exposed shield layer of a coaxial cable.

BACKGROUND ART

The need for effecting a satisfactory ground wire connection in applications which comprise a coaxial cable having a shield layer is well known in the art. For example, a typical cable connector assembly such as, without limitation, a connector assembly comprising an antenna connector and an antenna cable such as those used in the automobile industry for radios includes a male connector body generally in the form of a plug and a female connector body generally in the form of a ferrule which forms a socket. In use, the male connector body is plugged into the female connector body to effect a mechanical and electrical connection between the two. Typically, an antenna cable in the form of a coaxial cable is electrically and mechanically attached to one of the connectors such as the female connector, and the other connector, such as the male connector, is electrically and mechanically attached to a circuit such as a circuit on a printed circuit board. In assembling such prior an connector assemblies, it is usually necessary to trim the end of the coaxial cable and then fold the shield layer back upon the insulative jacket of the cable to provide a satisfactory ground. Typically, the coaxial cable is inserted into a conductive shell which forms an electrical connection between the shield layer and a mating connector. In other assemblies, wherein conductors such as a monofilament wire of a coaxial cable and a multifilament wire having an end connected to an insulated terminal housing are mechanically and electrically joined together, it is often desired to effect grounding of the shield layer of the coaxial cable. By way of example, such connections are also typically used with automobile antennas wherein a multifilament conductor is crimped to the monofilament central conductor of a coaxial cable which terminates at a vehicle antenna embedded in the glass of one of the vehicle windows. In such an application it may be desirable to provide a ground strap such as, for example, a flexible ground strap, electrically connected to the shield layer of the coaxial cable.

DISCLOSURE OF THE INVENTION

It is an object of the present invention to provide an improved ground member wherein a ground strap is electrically connected to a shield layer of a coaxial cable.

Another object of the present invention is to provide such an improved ground member in a connector module.

It is another object of the present invention to provide such an improved ground member in a connector module of the type wherein a splice is provided to join a central conductor of a coaxial cable and another conductor.

It is yet another object of the present invention to provide an improved method of electrically connecting a ground strap to a shield layer of a coaxial cable.

It is a further object of the present invention to satisfy any of the foregoing objects while providing a ground member which includes a flexible ground strap.

This invention achieves these and other objects by providing a ground member which comprises a sleeve and a coaxial cable. The coaxial cable comprises an insulative jacket, a central conductor which has a first distal end, and a length of exposed shield layer which extends into the sleeve. A ground strap is electrically connected to the shield layer by being sandwiched between the shield layer and the sleeve such as, for example, by crimping the sleeve. To this end, a conductive metal sleeve which may be readily crimped in a conventional manner may be provided. The ground member may be positioned in an insulator housing to provide a connector module. Such insulator housing may extend in the direction of a longitudinal axis from one end to an opposite end and comprise first and second insulator portions mechanically connected together to provide respective facing first grooves and respective facing second grooves, the first and second grooves extending in the direction of the longitudinal axis. The coaxial cable extends into one end of the insulator housing. The insulative jacket of the coaxial cable is sandwiched between the facing first grooves. A conductor is provided which extends into the opposite end of the insulator housing. The conductor comprises an insulative jacket, sandwiched between the facing second grooves, and a second distal end. The second distal end is electrically connected to the first distal end at a connecting length.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
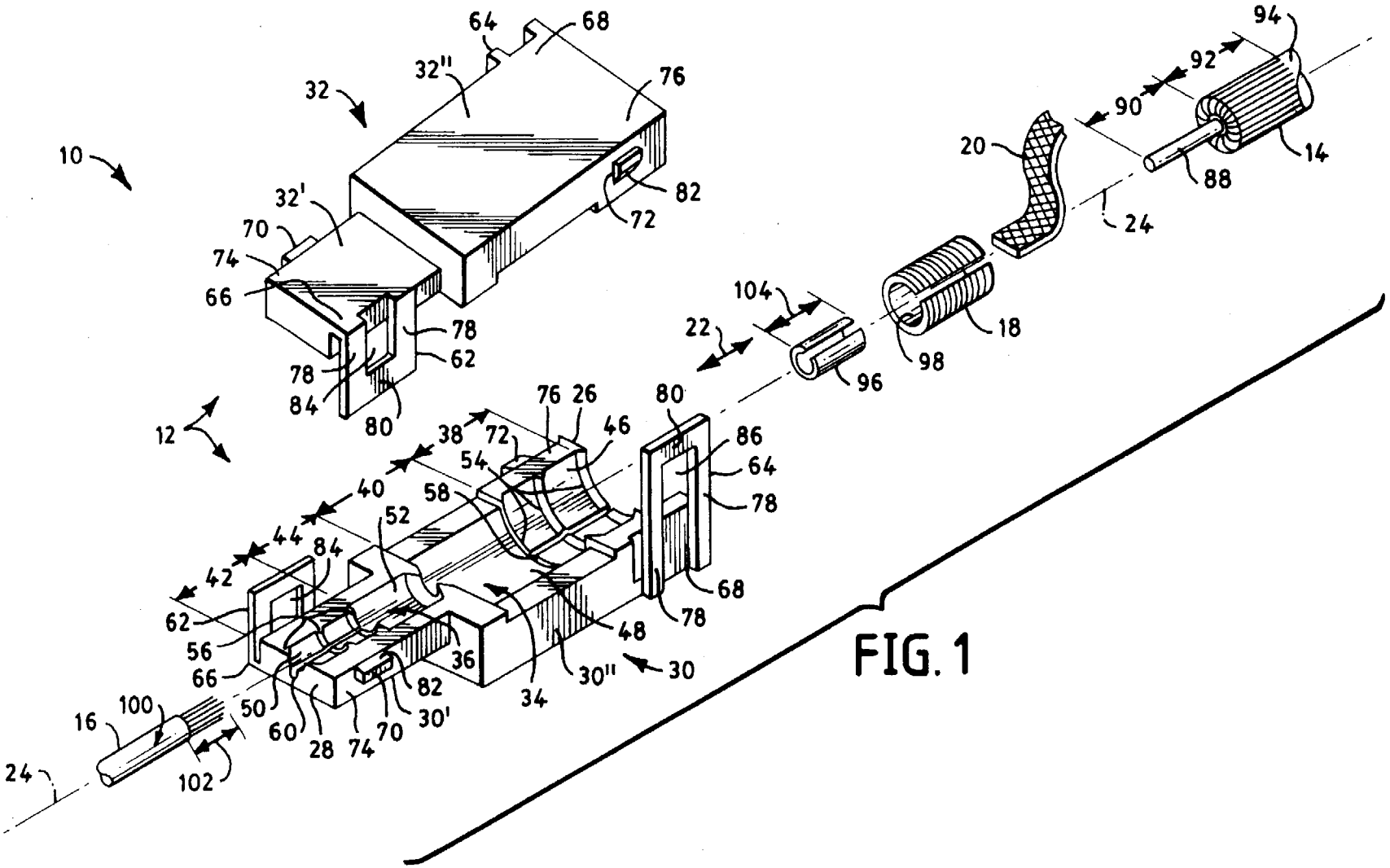
FIG. 1 is a perspective exploded view of one embodiment of the present invention.

FIG. 1 depicts a connector module 10 which comprises an insulator housing 12, coaxial cable 14, conductor 16, sleeve 18 and conductive ground strap 20.

Insulator housing 12 extends in the direction 22 of a longitudinal axis 24 from one end 26 to an opposite end 28. Insulator housing 12 comprises a first insulator portion 30 and an identical second insulator portion 32. Since the first insulator portion 30 and second insulator portion 32 are identical in configuration, only the internal features of the insulator portion 30 are depicted in the drawings.

Insulator portion 30 and insulator portion 32 may be connected together as described herein to provide respective facing first grooves 34 and respective facing second grooves 36 which extend in the direction 22 of axis 24. Each first groove 34 comprises a section 38 and an adjacent section 40. Similarly, each second groove 36 comprises a section 42 and an adjacent section 44. Sections 38 and 42 are adjacent ends 26 and 28, respectively. In this manner, section 38, 40, 42 and 44 provide a continuous groove which extends from end 26 to end 28. Grooves 38, 40, 42 and 44 are formed by partially cylindrical surfaces 46, 48, 50 and 52, respectively. Sections 38 and 42 each comprises at least one rib. For example, section 38 is depicted as comprising a plurality of circumferential ribs 54 which protrude from surface 46 towards axis 24. Similarly, section 42 is depicted as comprising a plurality of circumferential ribs 56 which protrude from surface 50 towards axis 24. Sections 38 and 42 also each comprise at least one elongated channel. For example, section 38 is depicted as comprising an elongated channel 58 which is recessed in surface 46 and extends in the direction 22 of axis 24. Similarly, section 42 is depicted as comprising an elongated channel 60 which is recessed in surface 50 and extends in the direction 22.

The first and second insulator portions of the present invention each comprise clip members and mating clip members respective of which are connectable to each other. For example, in the embodiment of FIG. 1, the first and second insulator portions 30 and 32 each comprise first and second clip members 62 and 64 at diagonally opposite comers 66 and 68, and first and second mating clip members 70 and 72 at diagonally opposite comers 74 and 76. The clip members 62 and 64, and the mating clip members 70 and 72, of insulator portion 30 are connectable to respective mating clip members 70 and 72, and clip members 62 and 64, of insulator portion 32. To this end, each clip member 62 and 64 comprises a pair of spaced resilient legs 78 which are connected at one end to an insulator portion and to each other at opposite distal ends by a bridging member 80. Each clip member 62, 64 of one insulator portion is connectable to a mating clip member 70, 72 which protrudes from an opposite insulator portion. Each mating clip member 70, 72 comprises a protuberance having an inclined surface 82 which provides a camming surface which cooperates with a respective bridging member 80 as described herein. When connecting the insulator portions 30 and 32 together, the camming surfaces 82 contact respective bridging members 80 causing opposing clip members 62, 64 to spread apart until the mating clip members 70, 72 snap into respective openings 84, 86 so that the mating clip members 70, 72 engage a respective bridging member 80 to lock the insulated portions 30 and 32 together. It will be apparent to those skilled in the art that the dimensions of the various clip members may vary. For example, the legs 78 of clip member 62 are somewhat shorter than corresponding legs 78 of clip members 64 in order to accommodate the variation in the size of opposing segments 30', 30" and 32', 32" of the insulator portions 30 and 32.

The connector module 10 comprises a conventional coaxial cable 14 which has been prepared in the usual manner to provide a central conductor 88 which forms a distal end 90 extending from the cable and a length 92 of shield layer folded back upon the cable insulative jacket 94. It will be apparent to those skilled in the art that length 92 of the shield layer may be provided in any other manner as by, for example, stripping the insulative jacket 94 to expose the length 92.

The coaxial cable 14 is inserted into conductive sleeve 18 such that the length 92 of the exposed shield layer extends into the conductive sleeve. Ground strap 20 is provided which is electrically connected to the exposed shield layer. To this end, ground strap 20 is sandwiched between the length 92 of the shield layer and the inner surface 98 of the conductive sleeve 18. To assure a satisfactory electrical and mechanical connection, the conductive sleeve 18 may be crimped to the end of the cable 14. Without limitation, in the embodiment of FIG. 1, ground strap 20 is flexible.

The connector module 10 comprises conductor 16 which is a conventional jacketed multifilament wire. Conductor 16 comprises an insulative jacket 100 and a conductive distal end 102. Multi filament distal end 102 is connected to monofilament central conductor 88 at distal end 90 to provide a connecting length. For example, the distal ends 90, 102 may be inserted into the sleeve-like crimping member 96, the crimping member then being crimped to provide a crimping length 104.

In assembling the device of the present invention, the end of the coaxial cable 14 may be stripped in a conventional manner to expose the length 90 of the central conductor and the shield layer, the shield layer then being folded back upon the insulative jacket 94. The conductive sleeve 18 may be loosely attached to the coaxial cable 14 adjacent the length 92 of the shield layer by inserting the cable into the sleeve, and the ground strap 20 may then be inserted between the shield layer and the conductive sleeve. The conductive sleeve 18 may then be crimped to the coaxial cable 14 to sandwich the ground strap 20 between the length 92 of the shield layer and the inner surface 98 of the conductive sleeve to electrically connect the ground strap to the shield layer and mechanically attach the ground strap to the coaxial cable.

The end of the conductor 16 may also be stripped in a conventional manner to expose the conductive distal end 102. The conductive distal end 102 of conductor 16, and the distal end 90 of the central conductor 88 of the coaxial cable 14, are electrically connected together. For example, the distal end 102 and the distal end 90 may be inserted into the sleeve-like conductive crimping member 96, the crimping member 96 then being crimped to electrically and mechanically connect the distal ends 102 and 90.

After the ground strap 20 has been connected to the coaxial cable 14 and the distal ends 90 and 102 have been connected together, the assembly may be inserted between first and second insulator portions, the insulator portions then being connected together to mechanically sandwich at least the insulative jackets 94 and 100 between the insulator portions. For example, the coaxial cable 14 may be inserted between insulator portions 30 and 32 at the end 26 of the insulator housing 12 such that the length of insulative jacket 94 adjacent the conductive sleeve 18 may be sandwiched between sections 38 of facing grooves 34. Similarly, the conductor 16 may be inserted between insulator portions 30 and 32 at the end 28 such that the length of insulative jacket 100 adjacent the distal end 102 may be sandwiched between sections 42 of facing grooves 36. When the insulator portions 30, 32 are assembled as described herein, the conductor 16 will extend from the end 28 of the insulator housing 10 and the coaxial cable 14 and ground strap 20 will extend from the end 26.

In the embodiment of FIG. 1, the insulator portions 30, 32 are configured such that when the connector module 10 is assembled, the conductive sleeve 18 will be positioned between insulator portions 30 and 32 such that the conductive sleeve 18 will be disposed between sections 40 of facing grooves 34. Similarly, the insulator portions 30, 32 may be configured such that when the connector module 10 is assembled, the connecting length 104 will be positioned between insulator portions 30 and 32 such that the connecting length will be disposed between sections 44 of facing grooves 36.

Figure 2:
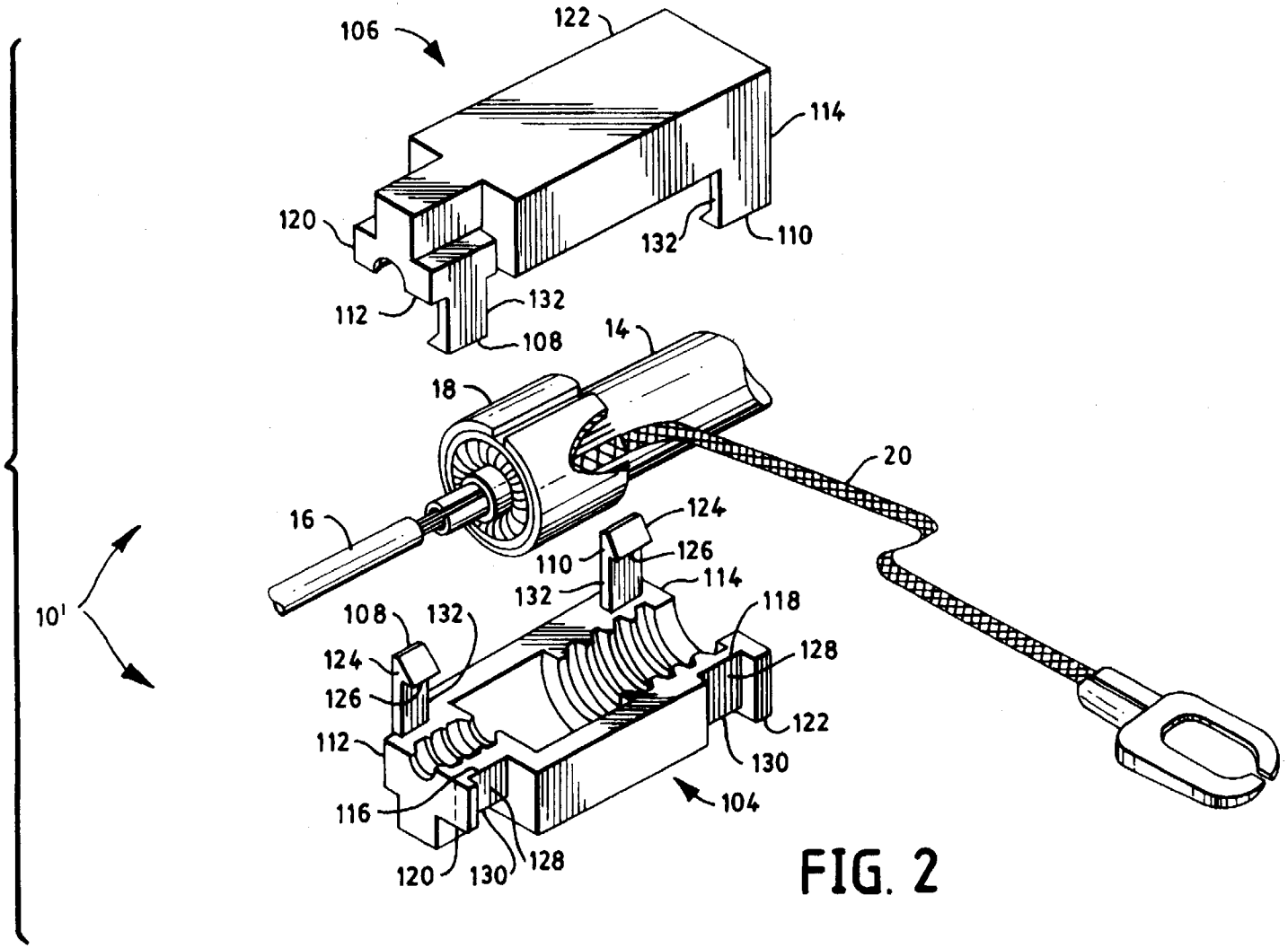
FIG. 2 is a perspective partially exploded view of an alternate embodiment of the present invention.

The insulator housing 12 may be configured as desired. For example, in an alternative embodiment of FIG. 2, where like reference numerals identify like components, a connector module 10' is provided wherein the assembled coaxial cable 14/ground strap 20/conductor 16 may be sandwiched between identical insulator portions 104, 106 which are similar to identical insulator portions 30, 32 except that in the embodiment of FIG. 2, the insulator portions 104, 106 comprise clip members 108 and 110 which are located at respective first adjacent comers 112 and 114, and mating clip members 116 and 118 which are located at respective adjacent comers 120 and 122. Clip members 108 and 110 each comprise a barbed distal end 124 having a locking surface 126. Mating clip members 116, 118 each comprise a recess portion 128 having a recess surface 130. In assembling the conductor module 10', the coaxial cable 14, ground strap 20 and conductor 16 are assembled as described herein regarding the embodiment of FIG. 1. The assembled coaxial cable 14/ground strap 20/conductor 16 is then positioned between insulator portions 104 and 106 as described herein regarding insulator portions 30 and 32. The insulator portions 104 and 106 may then be mechanically connected together. To this end, the barbed distal ends 124 of each insulator portion 104, 106 engage respective recess portions 128 of an opposing insulator portion 104, 106 so that the legs 132 are cammed apart until the barbed distal ends snap into place such that each recess surface 130 engages a respective locking surface 126 to lock the insulator portions 104, 106 together.

Fabrication of the various components described herein may be accomplished using conventional procedures. For example, the upper and lower insulator portions may be molded from a plastic material such as, without limitation, nylon or polypropylene. The conductive sleeve and the crimping member may be stamped from a metal sheet and then rolled and/or bent to form the desired configuration. The remaining components are conventional items.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

What is claimed is:

1. A connector module, comprising:

an insulator housing extending in the direction of a longitudinal axis from one end to an opposite end and comprising first and second insulator portions mechanically connected together to provide respective facing first grooves and respective facing second grooves, said first and second grooves extending in said direction;

a coaxial cable which extends into said one end of said insulator housing, said coaxial cable comprising an insulative jacket sandwiched between said facing first grooves, a central conductor having a first distal end, and a shield layer between said insulative jacket and said central conductor;

a sleeve adjacent said first distal end and mechanically connected to said coaxial cable;

a conductor which extends into said opposite end of said insulator housing, said conductor comprising an insulative jacket sandwiched between said facing second grooves, and a second distal end, said second distal end being electrically and mechanically connected to said first distal end at a connecting length; and a ground member electrically connected to said shield layer and extending out of said insulator housing, said ground member comprising a ground strap sandwiched between said sleeve and said shield layer.

2. The connector module of claim 1 wherein each first groove comprises a first section and an adjacent second section, said insulative jacket of said coaxial cable being positioned in said first section and said sleeve being portioned in said second section.

3. The connector module of claim 2 wherein each second groove comprises one section and another section adjacent thereto, said insulative jacket of said conductor being positioned in said one section and said connecting length being positioned in said another section.

4. The connector module of claim 3 wherein said ground strap extends out of said insulator housing at said one end.

5. The connector module of claim 1 wherein said first and second insulator portions each comprise clip members and mating clip members, said clip members of said first and second insulator portions being connected to respective mating clip members of said second and first insulator portions.

6. The insulator housing of claim 5 wherein said first and second clip members are located at respective first diagonally opposite comers, and said first and second mating clip members are located at respective second diagonally opposite comers.

7. The connector module of claim 6 wherein said first and second clip members each comprise a pair of spaced legs bridged together by a bridging member which comprises a bridging surface, and further wherein said first and second mating clip members each comprises a protuberance which engages a locking surface of a respective bridging member to lock said first and second insulator portions together.

8. The connector module claim 5 wherein said first and second clip members are located at respective first adjacent comers, and said first and second mating clip members are located at respective second adjacent comers.

9. The connector module of claim 8 wherein said first and second clip members each comprise a barbed distal end having a locking surface, and further herein said first and second mating clip members each comprise a recess portion having a recess surface, each recess surface engaging a respective locking surface to lock said first and second insulator portions together.

10. The connector module of claim 3 wherein said first section and said one section each comprise at least one rib extending towards said axis and an elongated channel extending in said direction.

11. A method of electrically connecting a ground strap to a shield layer of a coaxial cable, comprising the steps of:

(a) exposing a portion of a shield layer of a coaxial cable;

(b) inserting a length of said coaxial cable into a sleeve;

(c) inserting a ground strap between said shield layer and said sleeve;

(d) attaching said sleeve to said coaxial cable by sandwiching said ground strap between said sleeve and said shield layer to electrically connect said ground strap to said shield layer and form a subassembly; and inserting said subassembly between a first and second insulator portion, and connecting said first and second insulator portions together so as to mechanically sandwich at least an insulative jacket of said coaxial cable and an insulative jacket of a second conductor between said first and second insulator portions.

* * * * *